US009657546B2

(12) United States Patent
Williams et al.

(10) Patent No.: US 9,657,546 B2
(45) Date of Patent: May 23, 2017

(54) EXPANSION LIMITER FOR EXPANDABLE SEAL

(71) Applicant: BAKER HUGHES INCORPORATED, Houston, TX (US)

(72) Inventors: Jeffrey C. Williams, Cypress, TX (US); Benjamin T. Ronck, Houston, TX (US); Ziping Hu, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 279 days.

(21) Appl. No.: 14/276,496

(22) Filed: May 13, 2014

(65) Prior Publication Data

US 2015/0330175 A1 Nov. 19, 2015

(51) Int. Cl.
*E21B 33/12* (2006.01)
*E21B 33/128* (2006.01)
*E21B 33/129* (2006.01)

(52) U.S. Cl.
CPC ..... *E21B 33/1208* (2013.01); *E21B 33/128* (2013.01); *E21B 33/129* (2013.01)

(58) Field of Classification Search
CPC .... E21B 33/1208; E21B 43/103; E21B 23/01; E21B 33/129; E21B 43/108
See application file for complete search history.

(56) References Cited

U.S. PATENT DOCUMENTS

| | | | | |
|---|---|---|---|---|
| 6,564,870 | B1 | 5/2003 | Grigsby et al. | |
| 7,017,669 | B2 | 3/2006 | Johnston et al. | |
| 7,124,826 | B2 | 10/2006 | Simpson | |
| 7,124,829 | B2 | 10/2006 | Braddick | |
| 7,306,034 | B2 * | 12/2007 | Garcia | E21B 43/103 166/206 |
| 7,367,404 | B2 | 5/2008 | Simpson et al. | |
| 7,661,470 | B2 | 2/2010 | Doane et al. | |
| 7,779,924 | B2 | 8/2010 | Clamens | |
| 7,784,797 | B2 | 8/2010 | Baugh et al. | |
| 7,954,516 | B2 | 6/2011 | Hallundbaek | |
| 2001/0045746 | A1 | 11/2001 | Russell | |
| 2003/0188876 | A1 | 10/2003 | Vick et al. | |
| 2006/0065391 | A1 | 3/2006 | Carr | |
| 2007/0267824 | A1 | 11/2007 | Baugh et al. | |
| 2013/0269956 | A1 | 10/2013 | Yee | |

* cited by examiner

*Primary Examiner* — David Andrews
*Assistant Examiner* — Manuel C Portocarrero
(74) *Attorney, Agent, or Firm* — Steve Rosenblatt

(57) ABSTRACT

An expandable seal has at least one travel stop designed to engage the surrounding tubular to limit expansion of the ring shape of the seal and in so doing limit the stress of circumferential ribs that extend from the ring base shape as they engage the surrounding tubular. The travel stop can be a solid ring or segments and can have a rounded outer surface designed to engage the surrounding tubular in a flush relationship. Alternatively the outer surface can also have hardened particles for a bite into the wall of the surrounding tubular before the blunt portions of the travel stop come into contact with the inside wall of the surrounding tubular.

14 Claims, 5 Drawing Sheets

EXPANSION LIMITER FOR EXPANDABLE SEAL

FIELD OF THE INVENTION

The field of the invention is devices that prevent overexpansion of seal assemblies with respect to the surrounding tubular.

BACKGROUND OF THE INVENTION

Expandable seals have a swage driven through them and exterior features that are designed to engage and penetrate the surrounding tubular. Some designs feature circumferential ribs that have mirror image orientations in opposed directions that enable the seal to resist forces in opposed directions. Some designs add rubber sealing material that initially covers the ribs and that extends through the ribs when the seal is expanded from within. The ribs have relatively blunt points that to some degree deflect as the expansion progresses. In some instances additional gripping is warranted beyond the engagement of the angled ribs into the surrounding tubular and in those cases hardened inserts are used to enhance grip. In such case the insert particles are positioned to get more grip and in a manner of working with the angled ribs so as not to interfere with the flexing or penetration of such ribs into the wall of the surrounding tubular. U.S. Pat. No. 7,784,797 is a good example of such a design.

Other designs simply used hardened particles on an outer surface of a tubular that is expanded to anchor such tubular to the surrounding tubular. The hardened particles may be initially recessed for running in. Some examples of expandable anchors or seals are: U.S. Pat. Nos. 7,367,404; 7,124,826; 6,564,870; 7,661,470; 7,124,829; 7,954,516; 7,017,669 and 7,779,924.

What is not found in these prior designs is any way to effectively limit the radial expansion of such seals. Limiting the radial expansion prevents overstressing the seal that can initiate cracks especially under loading that can result in loss of grip. Overexpansion can overly flex the slanted ribs getting them to crack or have pieces break off. Various designs are illustrated that locate ring shape travel stops that have blunt leading ends to control the penetration or flexing of the inclined ribs against the surrounding tubular. Such blunt travel stops can also be equipped with raised sharp particles to accomplish a double duty of enhancing anchor grip while limiting radial expansion to limit stressing of the expanding ring that functions as the anchor. These and other features will be more readily apparent to those skilled in the art from a review of the preferred embodiments and associated drawings while recognizing that the full scope of the invention is to be determined from the appended claims.

SUMMARY OF THE INVENTION

An expandable seal has at least one travel stop designed to engage the surrounding tubular to limit expansion of the ring shape of the seal and in so doing limit the stress of circumferential ribs that extend from the ring base shape as they engage the surrounding tubular. The travel stop can be a solid ring or segments and can have a rounded outer surface designed to engage the surrounding tubular in a flush relationship. Alternatively the outer surface can also have hardened particles for a bite into the wall of the surrounding tubular before the blunt portions of the travel stop come into contact with the inside wall of the surrounding tubular.

DETAILED DESCRIPTION OF THE PREFERRED EMBODIMENT

Figure 1:
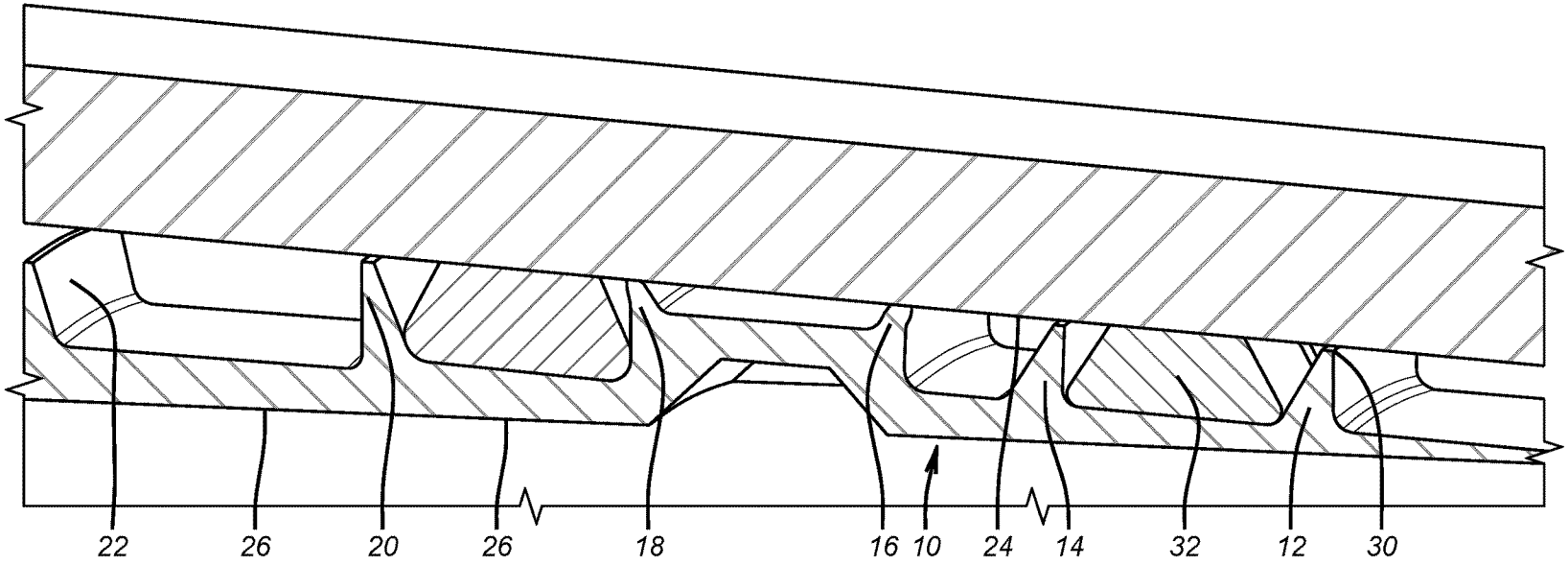
FIG. 1 is a section view of the expandable seal against a surrounding tubular with the travel stops in place.

FIG. 1 illustrates a segment of an expandable ring 10 that has circumferential ribs 12, 14 and 16 pointing in a downhole direction and three other circumferential ribs 18, 20 and 22 pointing in mirror image in an uphole direction. The peaks of all the ribs are preferably at the same height so as to engage the surrounding tubular inner wall surface 24 at the same time when a swage S is moved against surface 26 which is either the ring inner surface or a mandrel that is inside the ring. Radial expansion of ring 10 causes the ribs to react in several ways. The rib points such as 30 can either change shape from sharp to blunt or they can flex additionally in the direction of their initial orientation or they can simply deflect under compressive loading from the expansion. The concerns are that the surrounding tubular may not be perfectly round and without limit on the amount of radial expansion, there can be undue stress placed on the surrounding tubular from the rib ends that can initiate if not propagate wall cracks that could in short order lead to wall failures that will require a very expensive workover to repair.

Figure 2:
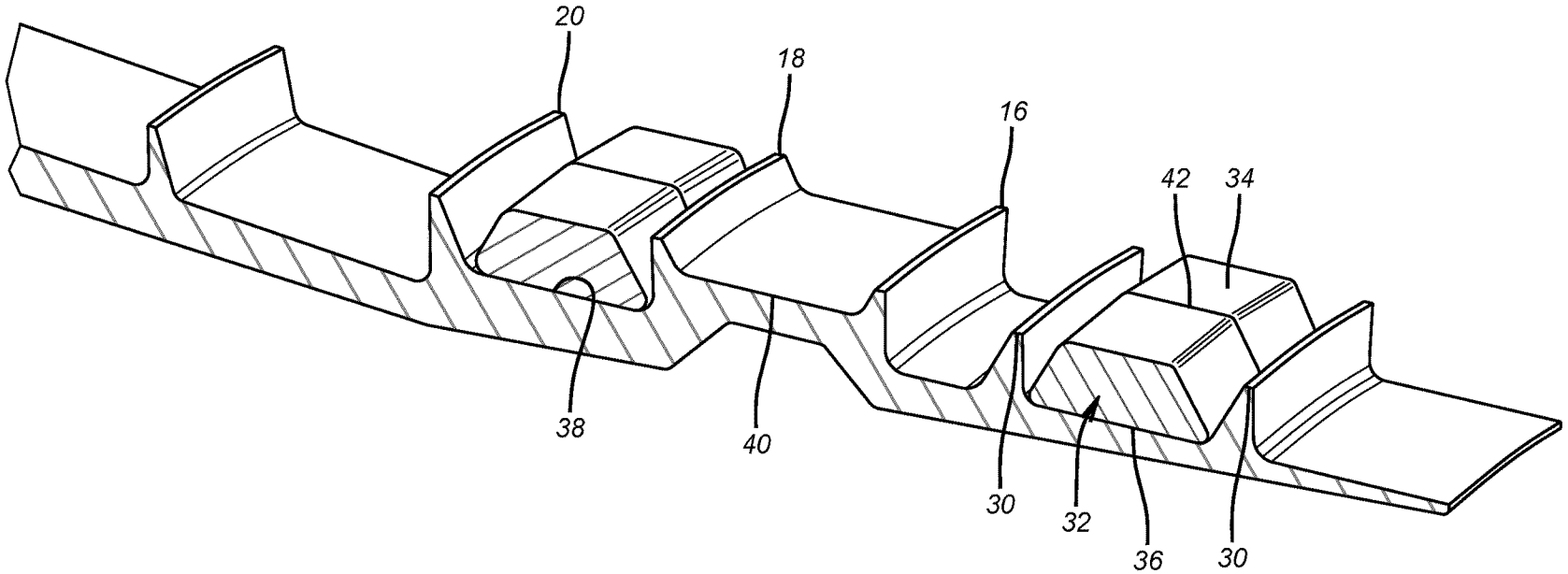
FIG. 2 is a perspective view of the expandable seal of FIG. 1.

To address this issue, the present invention seeks to limit the amount of such stress that is built up with one or more blunt travel stops that limit the amount of stress that can be transmitted at the rib ends. This stress can be very high because the rib ends are very narrow and in many cases come to a sharp edge for the specific purpose of embedding in the wall 24 for anchoring grip. As a result of very small contact area that almost approximates a line contact, the unit stress is very high. The travel stops 32 preferably have a trapezoidal cross-section although other shapes are contemplated. The outer of the two parallel sides 34 starts off shorter than the peaks 30 of ribs that are disposed on opposed sides of travel stop 32. The lower or inner surface 36 on the travel stop 32 sits on surface 38 which is in essence a valley floor defined by adjacent ribs such as 18 and 20. The travel stops 32 can be placed between or outside ribs such as 16 and 18 where the valley floor surface 40 extends further from the axis of the ring 10. In that case the height of the travel stop 32 that would be placed at that location will be shorter than the stops 32 shown in FIG. 2. As seen in FIG. 2 the stops 32 can be a ring with a single split 42 or in the alternative it can be a solid ring that is somewhat compliant during the expansion but provides sufficient radial direction resistance to expansion to limit applied stress to the surrounding tubular at the rib peaks. Alternatively, the stops 32 can be abutted segments that cover 360 degrees or fixed and spaced segments that cover less than 360 degrees and have one or more gaps between segments. Depending on the material from which the stops 32 are made there may be some flexing when the outer surfaces 34 contact the inside tubular wall 24 although this should be kept to a minimum and preferably eliminated. The large area of surface 34, which preferably conforms to the shape of the surrounding tubular wall 24, ensures that the stress is kept low due to the large unit area as compared to the adjacent ends 30 of all the ribs. It is not required to place stops 32 between each pair of ribs and it is preferred to space them equally or randomly along the height of the ring 10. The use of additional stops 32 especially if they are complete rings add to the force needed to expand the ring 10. In essence the height difference between the surface 34 on the stops 32 and the adjacent ends 30 of the ribs determines the amount of stress the ribs can put on the surrounding tubular.

Figure 3:
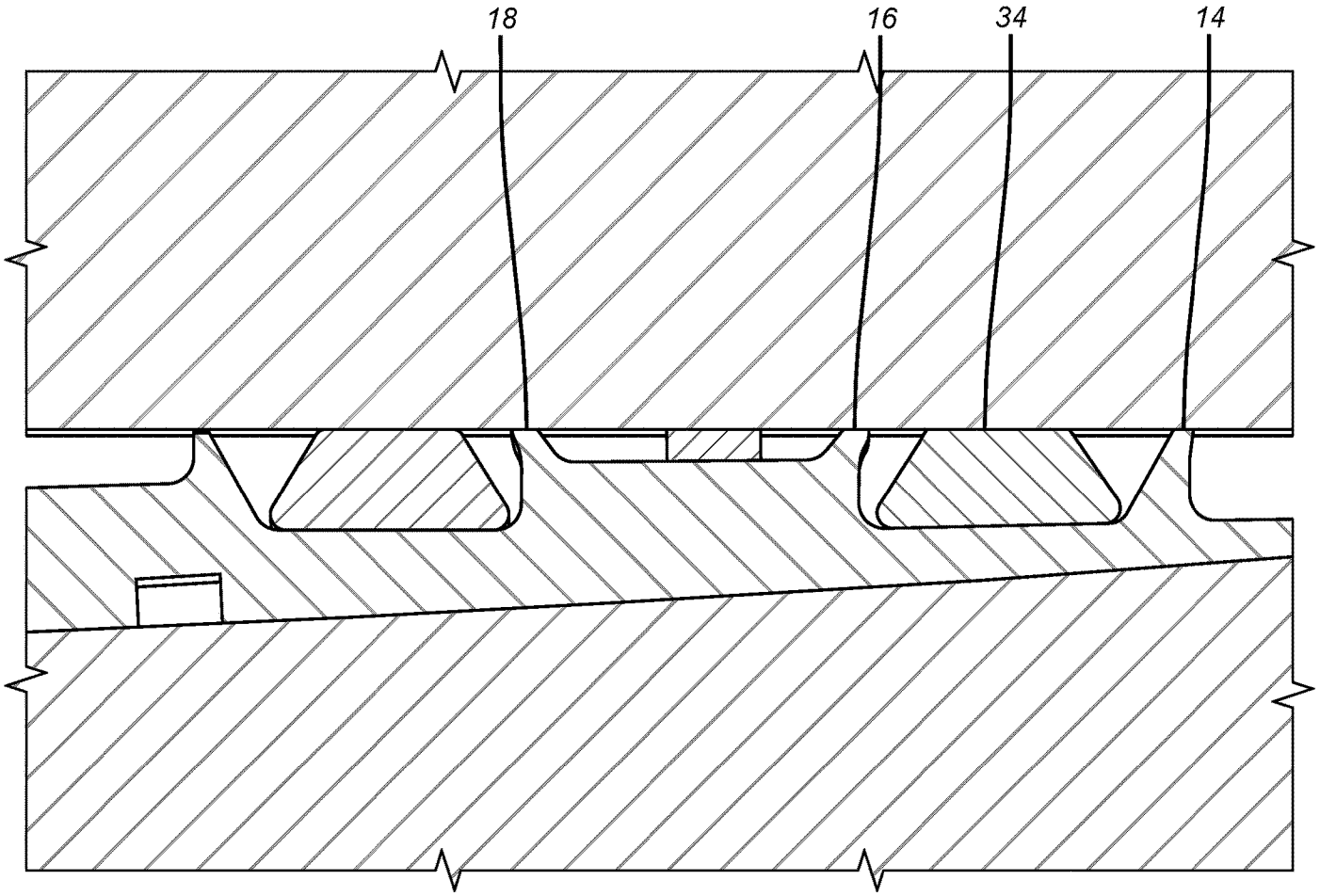
FIG. 3 shows the travel stops limiting expansion of the seal against the surrounding tubular.

FIG. 3 illustrates stops 32 of different thicknesses depending on their placement such that the stop between ribs 16 and 18 is shorter than another stop between ribs 14 and 16 but the top surface of each stop is initially preferably at the same height so that the control of stress is uniform over the length of a given ring 10. FIG. 3 also shows the rib ends as blunt which can be the result of the radial expansion against the surrounding tubular or the ends can be initially blunt to lower the stress concentration during radial expansion by providing a greater load area that reduces the unit stress. Preferably the outer surfaces 34 of the stops is at the same distance from the axis of the ring 10 although gradual outer surface height variations among the stops 32 are also contemplated.

Figure 4:
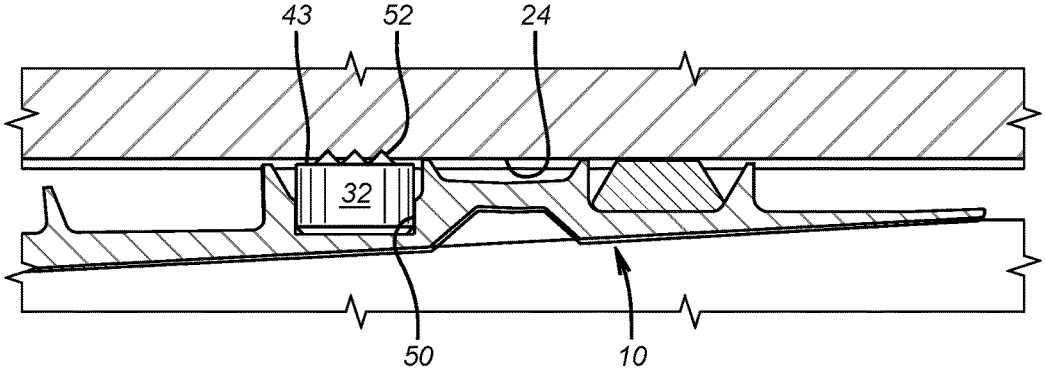
FIG. 4 is an alternative embodiment with hardened particles on the travel stops.
Figure 5:
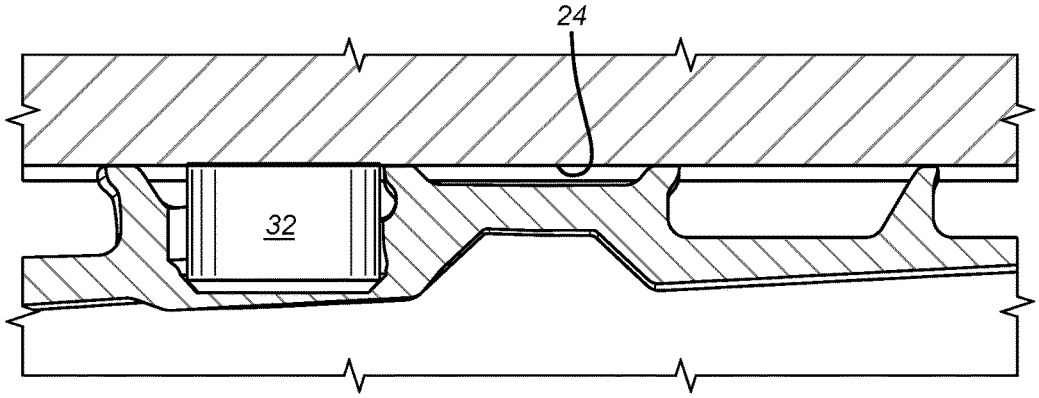
FIG. 5 shows a cylindrically shaped travel stop with the anchor in the set position.
Figure 6:
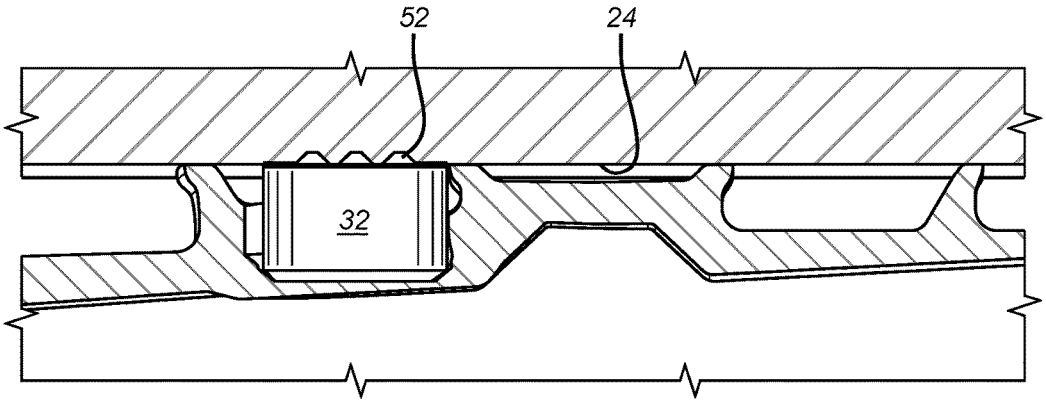
FIG. 6 is a variation of FIG. 5 with hard particles that penetrate the surrounding tubular.
Figure 7:
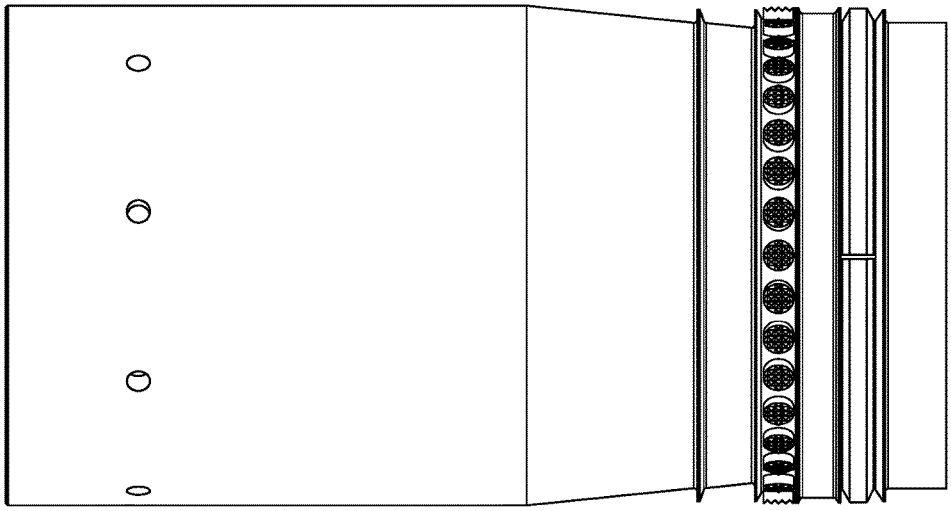
FIG. 7 is an exterior view showing two types of travel stops used together.
Figure 8:
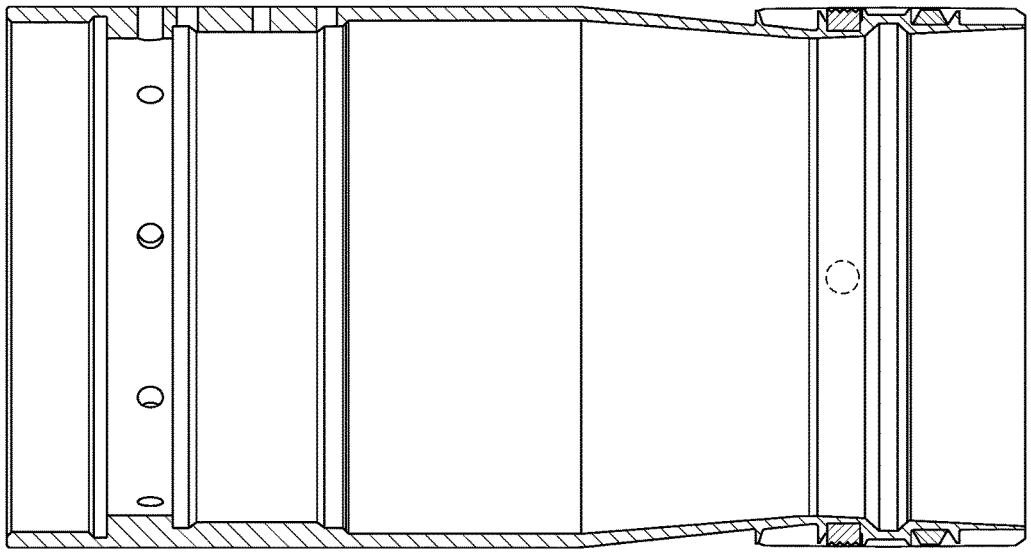
FIG. 8 is a section view of FIG. 7.

FIG. 4 shows another variation where the ring 10 has a recess 50 that is formed to the shape of the stop 32 but the top surface 43 also has hard particles that are intended to penetrate through the inner wall 24 of the surrounding tubular to bring outer surface 34 against inner surface 24 of the surrounding tubular for a travel stop as to the radial expansion. In this design there is the same travel stop effect but there is also the additional benefit of wall penetration for a better grip against forces in an uphole or downhole direction on the seal anchor when expanded into a supporting position from the surrounding tubular. The hard particles 52 are optional as can be seen in FIG. 5 which is the same as FIG. 4 but minus the hard particles. The stops in the case of FIGS. 4 and 5 can be cylindrical, quadrilateral or some other shape. Stops with hard particles can be used with other stops that do not have such particles as shown in FIG. 4. Alternatively stops with hard particles can be used exclusively as illustrated in FIG. 6. Stops in recesses formed to their shape such as in FIGS. 5 and 6 can be used exclusively with or without hard particles on the outer surface. FIGS. 7 and 8 illustrate the combination of round inserts with hard particles on the outer surface with the ring shaped stops that have a trapezoidal section where they are disposed between spaced rib pairs. Although trapezoidal sections are preferred for the ring shaped stops other sectional shapes are contemplated such as quadrilateral, square or polygonal. The hard particles can be carbide or polycrystalline diamonds. As such hard particles penetrate they make it possible for the stop surface 34 on which they are attached to come into contact with the inside wall 24 of the surrounding tubular to act as a travel stop.

The travel stops can not only enhance grip with the use of hard particles but they can also limit stress of the ribs contacting the surrounding tubular. By setting a predetermined height difference between the outer face of the stops and the contact location for the ribs in the run in position the amount of radial applied force to the surrounding tubular through the rib leading ends is limited. The applied stress to the surrounding tubular is thus also limited to control the initiation or propagation of stress cracks in the wall of the surrounding tubular thus avoiding costly well workovers or other safety concerns brought about by tubular failure in the borehole.

The intended purpose of the stops is not to act as a seal but to fulfill a primary purpose as a travel stop. The stops can be segments with gaps between them so they do not seal at all. Alternatively, they can be complete rings with some possibility of acting as a seal although using such a variation would increase the needed force to get the desired amount of radial expansion.

The above description is illustrative of the preferred embodiment and many modifications may be made by those skilled in the art without departing from the invention whose scope is to be determined from the literal and equivalent scope of the claims below:

We claim:

1. An expandable seal for subterranean use in a surrounding tubular, comprising:

a mandrel having an axis and a passage therethrough for movement of a swage to increase an outer dimension thereof;

a ring mounted on said mandrel comprising a plurality of extending ribs having an initial height before expansion from said axis;

at least one travel stop positioned on said ring and between said ribs and having an outer surface before expansion that conforms to the shape of the surrounding tubular and which is disposed at a distance from said axis that is shorter than said initial height of said ribs and longer than an adjacent outer surface on said ring, said travel stop limiting radial expansion of said ribs against the surrounding tubular;

said travel stop limits the penetration or deflection of said ribs into the surrounding tubular.

2. The seal of claim 1, wherein:

said travel stop has a ring shape.

3. The seal of claim 2, wherein:

said travel stop has at least one gap.

4. The seal of claim 1, wherein:

said travel stop comprises spaced segments.

5. The seal of claim 1, wherein:

said travel stop has a trapezoidal cross-section.

6. The seal of claim 1, wherein:

said travel stop comprises hard particles on an outer surface thereof.

7. The seal of claim 6, wherein:

said outer surface of said travel stop contacts the surrounding tubular when said hard particles embed in the surrounding tubular.

8. The seal of claim 1, wherein:

said travel stop comprises spaced inserts fitted into a recess on said ring.

9. The seal of claim 8, wherein:

said inserts have a round, quadrilateral or polygonal shape.

10. The seal of claim 1, wherein:

said travel stop comprises a ring shape between two ribs and spaced apart shapes between a second pair of ribs.

11. The seal of claim 10, wherein:

at least some of said spaced apart shapes have hard particles from said outer surface thereof.

12. The seal of claim 1, wherein:

said ribs on said ring are oriented in opposed directions.

13. The seal of claim 1, wherein:

said ribs have blunt ends that abut the surrounding tubular.

14. The seal of claim 1, wherein:

said travel stop does not fluid seal against the surrounding tubular on contact therewith.

* * * * *